US006392609B2

(12) United States Patent
Nieminen

(10) Patent No.: US 6,392,609 B2
(45) Date of Patent: May 21, 2002

(54) ANTENNA DEVICE AND AN ANTENNA ASSEMBLY

(75) Inventor: Otso Nieminen, Södervägen (SE)

(73) Assignee: SMARTEQ Wireless AB, Enebyberg (SE)

( * ) Notice: Subject to any disclaimer, the term of this patent is extended or adjusted under 35 U.S.C. 154(b) by 0 days.

(21) Appl. No.: 09/788,405

(22) Filed: Feb. 21, 2001

(30) Foreign Application Priority Data

Feb. 22, 2000 (SE) ..... 0000575

(51) Int. Cl.[7] ..... H01Q 13/10
(52) U.S. Cl. ..... 343/767; 343/700 MS
(58) Field of Search ..... 343/700 MS, 746, 343/750, 768, 767, 769

(56) References Cited

U.S. PATENT DOCUMENTS 5,914,693 A * 6/1999 Takei et al. ..... 343/700 MS
6,028,561 A * 2/2000 Takei ..... 343/767
6,031,503 A * 2/2000 Preiss et al. ..... 343/702
6,150,989 A * 11/2000 Aubry ..... 343/767
6,225,959 B1 * 5/2001 Gordon ..... 343/700 MS

* cited by examiner

*Primary Examiner*—Don Wong
*Assistant Examiner*—Shih-Chao Chen
(74) *Attorney, Agent, or Firm*—Jacobson Holman, PLLC

(57) ABSTRACT

The present invention relates to an antenna device comprising a dielectric substrate (11;61) having at least one electrically conductive layer, a feeding (19) and a grounding (18) point. The antenna device is provided with a slot (14;71;81;91) having a closed path between an outer conductive region (12) and an inner (13) conductive region and is further provided with a feed slot (17;41;82;92;104) arranged at a first side of said closed slot (14;71;81;91), extending from said closed slot and outwards. A feeding means (2) is arranged to be connected to said feeding point (19) provided on said outer electrically conductive region (12) on a first side (15;16;73) of said feed slot (17;41;82;92;104), and a grounding means (3) is arranged to be connected to said ground point 18 provided on said outer electrically conductive region (12) on a second side, opposite to said first side, of said feed slot (17;41;82;92;104). The present invention also relates to an antenna assembly (110, 120,130).

23 Claims, 4 Drawing Sheets

ANTENNA DEVICE AND AN ANTENNA ASSEMBLY

TECHNICAL FIELD

The present invention relates to an antenna device according to the preamble of claim 1. The present invention also relates to an antenna assembly comprising at least one antenna device and another antenna device according to the preamble of claim 23.

BACKGROUND ART

The most common used antenna type for GPS applications is a microstrip antenna, a so called patch antenna. The main disadvantage with the microstrip antennas is relatively high manufacturing costs. Another disadvantage is that microstrip antennas have a high built-in height, due to the fact that they require an earth plane and an intermediate dielectric material.

Other types of antennas having circular polarisation characteristics, which are cheaper to produce, are some types of helix-antennas or double-loop antennas. The drawback with this type of antenna is that they cannot be compared to the patch antenna in terms of narrow bandwidth and antenna gain. Narrow bandwidth is a crucial requirement for a GPS antenna in order to reduce noise and interference e.g. from a cellular phone antenna near by.

SUMMARY OF THE INVENTION

The present invention seeks to provide an antenna device, especially for GPS applications, which is cheap to manufacture and has a narrow bandwidth compared to prior art antennas.

According to an aspect of the present invention, there is provided an antenna device as specified in claim 1.

The invention is also directed to an antenna assembly combining the antenna device with another antenna as specified in claim 23.

An advantage with the present invention is that the antenna device is cheap to manufacture.

Another advantage with the present invention is that the antenna device has a narrow bandwidth, suitable for GPS applications.

Still another advantage is that the present invention has a low built-in height compared to prior art antennas.

An advantage with an embodiment of the present invention having a reflector is that the antenna gain of the antenna device can be increased compared to an antenna device without a reflector.

An advantage with the antenna assembly is that the antenna device according to the present invention may easily be integrated with another antenna device, not affecting the height of the antenna assembly.

DETAILED DESCRIPTION THE PREFERRED EMBODIMENTS

Figure 1:
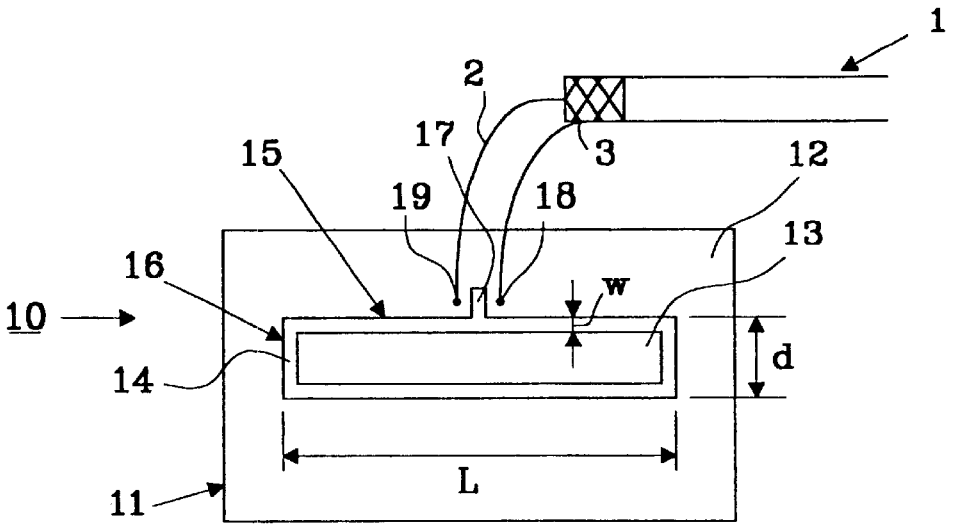
FIG. 1 shows a top view of a first embodiment of the present invention without a reflector.

FIG. 1 shows a top view of a first embodiment of an antenna device 10 according to the present invention. The antenna device 10 comprises a dielectric substrate 11, preferably a PCB (Printed Circuit Board). The dielectric substrate may be made out of a flexible material, as described in connection with FIG. 6. The upper surface of the substrate is provided with an electrically conductive layer, preferably a metal coating.

The conductive layer is divided into an outer region 12 and an inner region 13, where the inner and outer regions are conductively separated from each other by a slot 14 having a closed path. The slot has, in this example, an essentially rectangular path in the conductive layer, and a first side 15 having a length L which is greater than a length d of a second side 16, where said second side 16 is perpendicular to said first side 15. The length L is approximately one half of the wavelength of the desired frequency to be received or transmitted by the antenna. The length d is preferably much smaller than L. The length d of the second side have to be greater than two times the width of the slot w. If $d<2w$, there will be no inner electrically conductive region 13 and the antenna device will not function in a desired way. The width w of the closed slot is preferably in the range of a couple of mm.

A feed slot 17 is arranged preferably at the centre of the first side 15, where said feed slot 17 extends from the closed slot 14 and, in this example, essentially perpendicularly outwards into the outer region 12. The length of the feed slot may be used for fine tuning the antenna frequency and the width of the feed slot is approximately the same as the width w of the rectangular slot 15.

Feeding means and grounding means in the form of a coaxial cable 1 is provided to be connected to the antenna device 10. The signal line 2 of the coaxial cable 1, being the feeding means, is in this example connected to a feed point 19 on the outer region 12 of the conductive layer close to, and on one side of, the feed slot 17. The shield 3 of the coaxial cable 1, being the grounding means, is in this example connected to a ground point 18 on the outer region 12 close to, and on an opposite side compared to the feed point 19, of the feed slot 17. Other ways of connecting the feeding and grounding means will be disclosed in the further embodiments.

Figure 2:
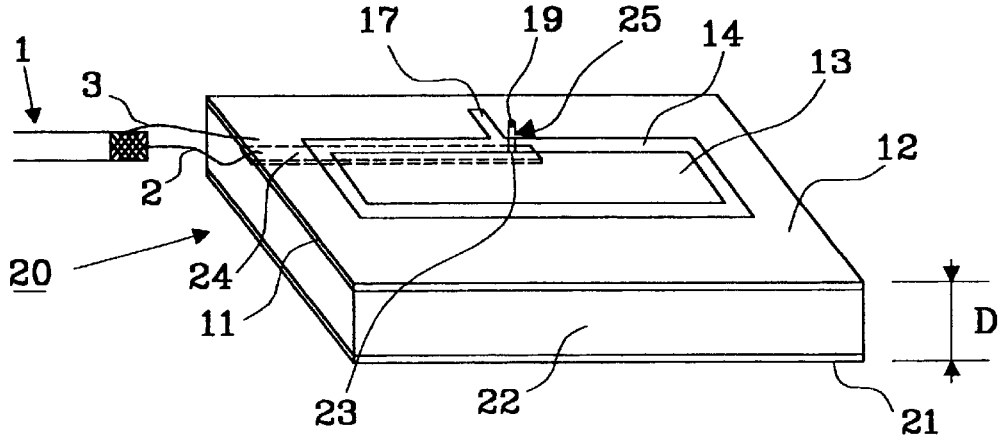
FIG. 2 shows a perspective view of a second embodiment of the present invention having a reflector.

FIG. 2 shows a perspective view of a second embodiment of an antenna device 20. The antenna device 20 comprises a dielectric substrate 11 carrying an electrically conductive layer, said conductive layer is separated into an outer 12 and an inner 13 region by a closed slot 14, which is provided with a feed slot 17, as described in FIG. 1. The antenna device 20 further comprises a reflector 21, which is a metal sheet arranged at a distance D from the dielectric substrate 11. The space 22 between the substrate 11 and the reflector may be filled with a dielectric material. The length L of the closed slot 14 may have to be adjusted to compensate for influence of the dielectric material.

By adding a reflector to the antenna structure described in FIG. 1, the antenna gain may be increased. In this example the space 22 is filled with a solid dielectric material as a part of the antenna structure. By using a dielectric material with a higher epsilon the distance D may be decreased, which in turn means that the antenna device is less space consuming.

The coaxial cable 1 is connected to the antenna device 20 at the side of the substrate 11. The shield 3 is connected to the outer region 12 of the conductive layer, either direct or indirect through a connector (not shown). The signal line 2 is connected to a contact point 23, via a waveguide 24, on a reverse side of the substrate 11, opposite to the side carrying the conductive layer. The contact point 23 is electrically coupled to a feed point 19 on the outer region 12 of the conductive layer. This coupling 25 may be performed by e.g. a via hole or a pin through the substrate 11.

The signal line 2 is in this example connected to a contact point 23 by a microstrip line 24 as waveguide, marked with dashed lines, between the edge of the substrate 11 and the contact point 23. This simplifies the manufacturing process considerably, especially-when using a solid dielectric material in the space 22. The signal line 2 may be directly connected to the waveguide or indirect through a connector (not shown).

Figure 3:
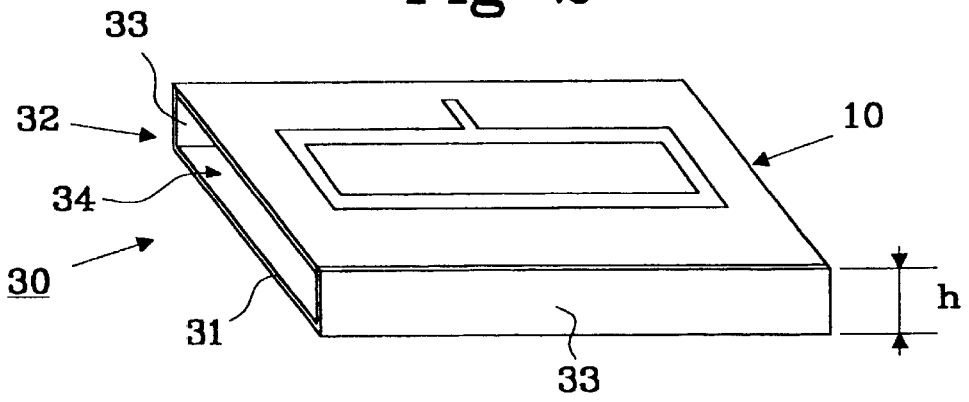
FIG. 3 shows a perspective view of a third embodiment of the present invention having an alternative reflector structure.

FIG. 3 shows a third embodiment of an antenna device 30 comprising an alternative way of implementing a reflector 31 to an antenna device 10 as described in connection with FIG. 1.

The reflector 31 is a part of a shielding box 32. The shielding box 32 comprises two side walls 33, having preferably the same height h. The height of the side walls may differ in some application to e.g. obtain a tilted angle to the reflector 31. The side walls 33 are connected to the reflector 31 in a preferably perpendicular fashion on two opposite sides of the reflector 31, thereby forming a U-shaped shielding box 32. The side walls 33 are preferably an integrated part of the reflector and is made of the same material as the reflector 31. The shielding box 32 is preferably made out of a single metal sheet, which is folded in such a way to give the desired shape as in FIG. 3.

The substrate 11 is arranged on the top of the side walls 33, and the outer conductive region may or may not be in electrical contact with the shielding box. This electrical contact may be performed by soldering. In this example the space 34 is filled with air as a dielectric material.

Figure 4:
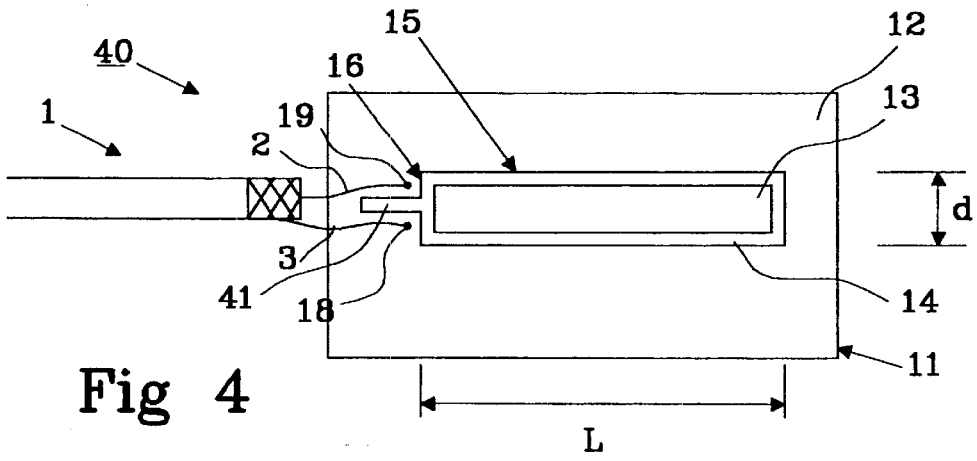
FIG. 4 shows an alternative placement of the feed slot of the embodiment in FIG. 1.

FIG. 4 shows a top view of an antenna device 40 having an alternative placement of the feed slot from FIG. 1. The antenna device comprises a dielectric substrate 11 with an electrically conductive layer arranged on the upper surface. The conductive layer is divided into an outer conductive region 12 and an inner conductive region 13, separated by a closed slot 14, as previously described in FIG. 1.

The closed slot 14, having a rectangular shape, is provided with a short side 16, having a length d, and a longer side 15, having a length L. In this embodiment a feed slot 41 is provided at the short side 16, preferably at the centre of the side. A coaxial cable 1, having a signal line 2 and a shield 3 is connected to a feed point 19 and a ground point 18, respectively. The feed point 19 being arranged on one side of the feed slot 41, and the ground point 18 being arranged on an opposite side of the feed slot 41. The length of the feed slot 41 may have to be adjusted, compared to the length of the feed slot 17 in FIG. 1, for the antenna device to be tuned for the same frequency as the antenna device in FIG. 1.

Figure 5A:
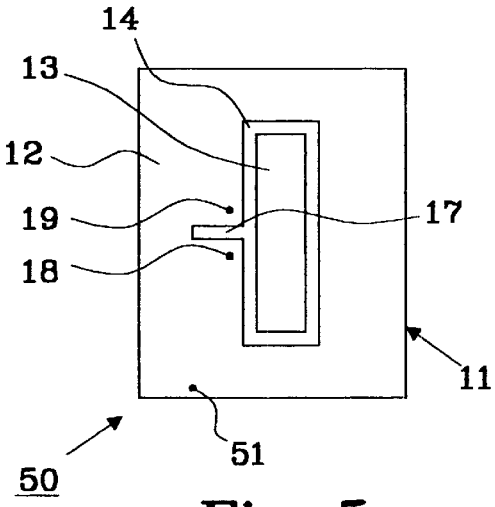
FIGS. 5*a* and 5*b* shows a top view and a rear view of a fourth embodiment of the present invention having an integrated amplifier.
Figure 5B:
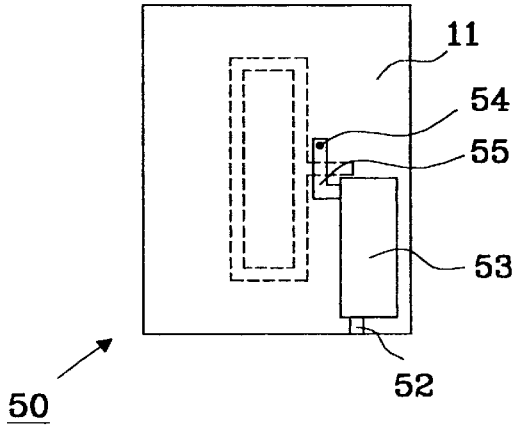

FIGS. 5*a* and 5*b* shows a top view and a rear view of an antenna device 50 adapted for use with GPS applications, where an amplifier and a filter are integrated. The antenna device 50 in FIG. 5*a* is similar to the top view shown in FIG. 1. The antenna device 50 is provided with a dielectric substrate 11 having an electrically conductive layer, which is divided into an outer conductive region 12 and an inner conductive region 13 electrically separated by a rectangularly shaped closed slot 14, which is provided with a feed slot 17 at one of the longer sides. A feed point 19 is provided on one side of the feed slot 17 and a ground point 18 is provided on an opposite side of said feed slot 17 compared to said feed point 19. A grounding means is connected to a connection point 51 at the edge of the outer region 12.

FIG. 5*b* shows the reverse side of the dielectric substrate 11 of the antenna device 50. A waveguide 52 is arranged between the edge of the substrate 11 and an integrated circuit device and/or lumped components 53, e.g. an amplifier, preferably a low noise amplifier and/or a filter. The integrated circuit device and/or lumped components 53 is in turn connected a feed connection point 54, via waveguide 55. It is preferred that the waveguide 55 from the integrated circuit device 53 to the feed connection point 54 passes over the reverse side of the feed slot 17, thus enhancing the properties of the antenna.

The feed connection point 54 is connected to the feed point 19 on the other side of the substrate 11 by e.g. a via hole or a pin. Grounding and feeding means may be connected between the ground point 51 and the waveguide 52, respectively.

Figure 6:
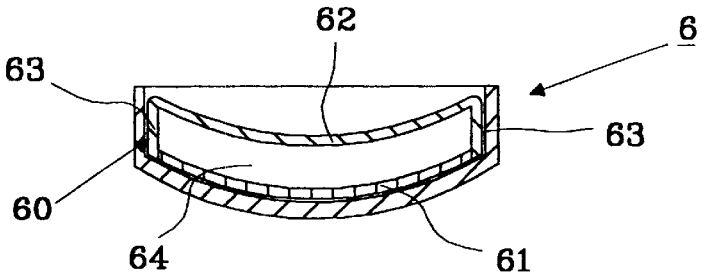
FIG. 6 shows cross section of a flexible embodiment of the present invention mounted in a hand held communication device.

FIG. 6 shows a cross section view of a communication device 6 having an antenna device 60 according to the present invention. The antenna device in this example comprises a flexible substrate 61, which is mounted in the communication device 6 in such a way that it follows the shape of the cover of the communication device 6, and a reflector 62 having side walls 63. The reflector 62 is mounted to the substrate in such a way to follow the shape of the substrate, i.e. they are essentially parallel to each other, thus creating a space 64.

The shape of the slot having a closed path may be altered in many ways and still keep the essential properties for the antenna device. In the following figures a number of different shapes will be disclosed and discussed.

Figure 7A:
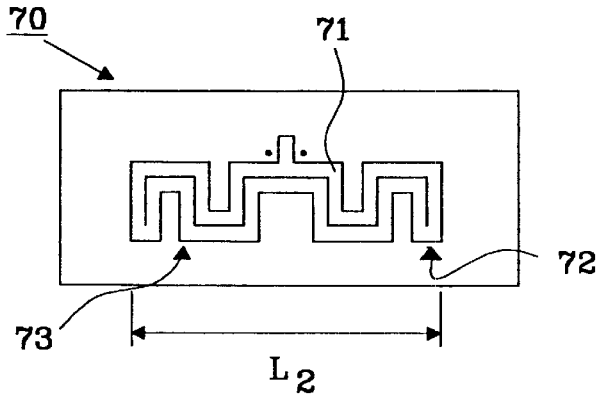
FIGS. 7*a* and 7*b* shows two embodiments of an antenna device according to the invention having a closed slot with a meandering path.

FIG. 7*a* shows an antenna device 70 having a slot 71, which has a closed meandering path. The short side 72 of the slot 71 is in this example minimised to decrease the space needed. The electrical length of the longer side 73 is approximately the same as the length L in FIG. 1, provided the antenna devices are tuned for the same frequency. By adding the meandering path to the rectangular slot in FIG. 1, the physical length $L_2$ of the slot may be decreased, $L_2<L$, thus resulting in a smaller device 70.

Figure 7B:
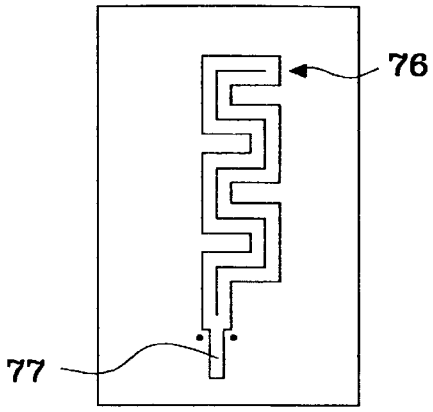

FIG. 7*b* shows another embodiment of an antenna device 75, which has a closed meandering path. In this embodiment the short side 76 is minimised and a feed slot 77 is provided at one of the short sides 76.

Figure 8:
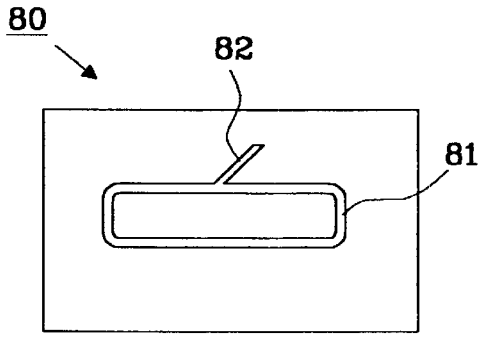
FIG. 8 shows an antenna device according to the invention having a slot with a first alternative shape.

FIG. 8 shows an antenna device 80 having a closed slot 81, having a rectangular shape with rounded off corners and a feed slot 82 provided at one side. This feed slot 82 does extend outwards from the closed slot 81, as described previously, but at an angle of approximately 45 degrees.

Figure 9:
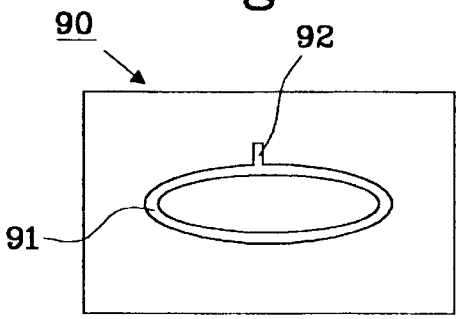
FIG. 9 shows an antenna device according to the invention having a slot with a second alternative shape.

FIG. 9 shows an antenna device 90 having a closed slot 91, having an elliptic shape, which is provided with a feed slot 92 at an arbitrary point of the closed path extending outwards as described previously.

Figure 10A:
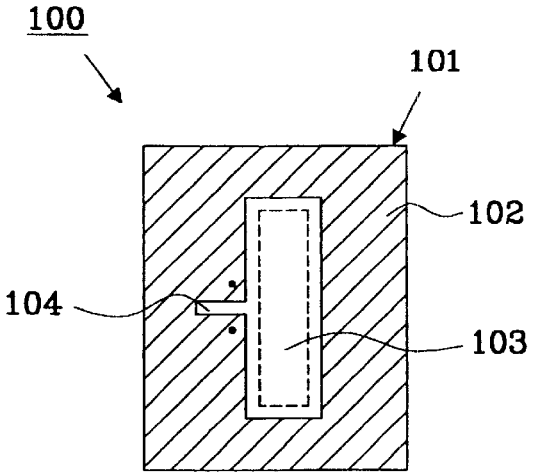
FIGS. 10*a* and 10*b* shows an alternative way of implementing an antenna device similar to the embodiment in FIG. 1.
Figure 10B:
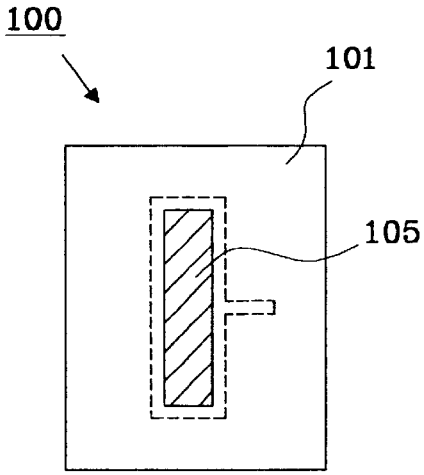

FIGS. 10*a* and 10*b* shows an alternative way of implementing the antenna device 100, similar to that of FIG. 1. FIG. 10*a* shows the top view of a dielectric substrate 101, being coated with an electrically conductive layer 102 provided with a hole 103 in the shape of a rectangle and a feed slot 104.

The reverse side of the substrate 101 is shown in FIG. 10*b*, being provided with a electrically conductive layer 105 in the shape of a rectangle. The size of the rectangle 105 is less than the size of the corresponding hole provided on the top surface, as indicated by the dashed lines in both FIG. 10*a* and 10*b*.

Figure 11:
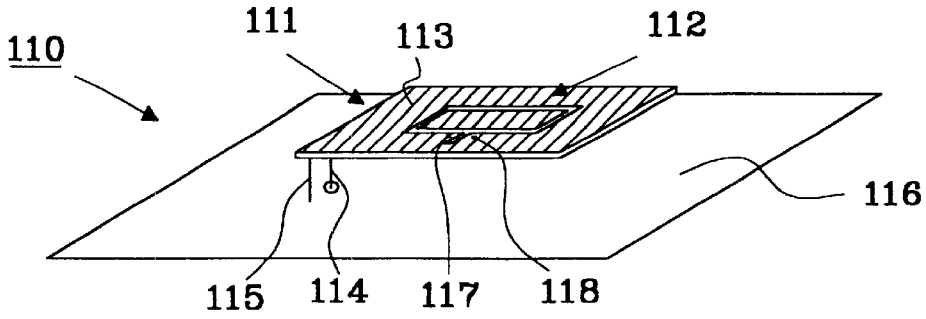
FIG. 11 shows an antenna assembly having a combination of a PIFA antenna for GSM and a GPS antenna.

FIG. 11 shows an antenna assembly 110 comprising a GSM PIFA-antenna 111 (Planar Inverted F-Antenna) and a GPS antenna device 112 according to the present invention. The PIFA-antenna is, in this example, provided with a substrate carrying a conductive coating 113, which is connected to a feed 114 and ground line 115 for GSM signals. The ground line 115 is connected to a ground plane 116. The GPS antenna 112 is arranged in the conductive coating 113 as previously described. The GPS antenna is provided with a ground 117 and a feeding 118 point to be connected to a GPS application.

Figure 12:
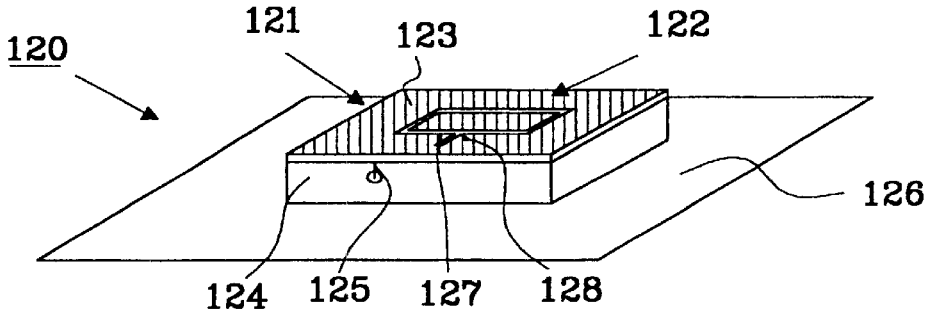
FIG. 12 shows an antenna assembly having a combination of a patch antenna for GSM and a GPS antenna.

FIG. 12 shows an antenna assembly 120 comprising a GSM patch antenna 121 and a GPS antenna 122 according to the present invention. The patch antenna comprises a conductive sheet 123 arranged on top of a dielectric material 124. The conductive sheet is provided with a feed line 125 for GSM signals and is also provided with a ground plane 126. The GPS antenna 122 is arranged in the conductive coating 123 as previously described. The GPS antenna is provided with a ground 127 and a feeding 128 point to be connected to a GPS application.

Figure 13:
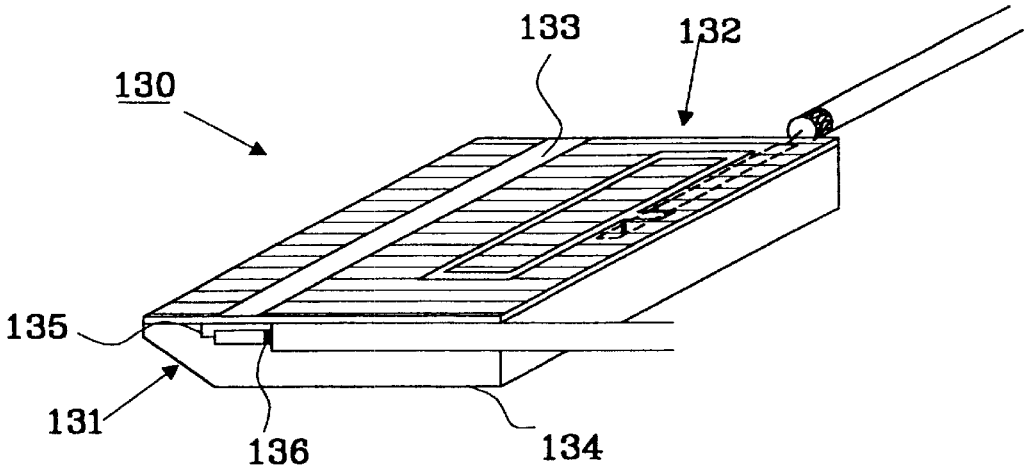
FIG. 13 shows an antenna assembly having a combination of an extended loop antenna for GSM and a GPS antenna.

FIG. 13 shows an antenna assembly 130 comprising an extended loop antenna 131, as disclosed in the Swedish patent application SE0000289-9, which is hereby incorporated as reference, and a GPS antenna 132 according to the present invention. The extended loop antenna 131 comprises a substrate carrying a metal coating. The metal coating is divided by a slit 133 defining two separate conductive areas where the GPS antenna 132 may be implemented. The extended loop antenna further comprises a folded metal piece 134, which is connected to the separated conductive areas. A feeding means 135 is connected to one side of the slit 134 and a grounding means 136 is connected to the other side of the slit for GSM signals. The GPS antenna 132 is arranged in the conductive area as previously described. The GPS antenna is provided with a ground 137 and a feeding 138 point to be connected to a GPS application as previously described in connection to FIG. 2.

What is claimed is:

1. An antenna device comprising a dielectric substrate (11;61) having at least one electrically conductive layer, a feeding (19) and a grounding (18) point, and said antenna device is provided with a slot (14;71;81;91) having a closed path between an outer conductive region (12) and an inner (13) conductive region of said at least one conductive layer, characterised in that a feed slot (17;41;82;92;104) is arranged at a first side of said closed slot (14;71;81;91), extending from said closed slot and outwards, a feeding means (2) is arranged to be connected to said feeding point (19) provided on said outer electrically conductive region (12) on a first side (15;16;73) of said feed slot (17;41;82;92;104), and a grounding means (3) is arranged to be connected to said ground point (18) provided on said outer electrically conductive region (12) on a second side, opposite to said first side, of said feed slot (17;41;82;92;104).

2. The antenna device according to claim 1, wherein said feed slot (17;41;82;92;104) is arranged essentially at the centre of said first side (15;16;73) of the closed slot (14;71;81;91).

3. The antenna device according to claim 1, wherein said first side (15;73) of the closed slot (14;71;81;91) is longer than a second side (16;72) of the closed slot, said second side (16;72) being essentially perpendicular to said first side (15;72).

4. The antenna device according to any of claim 1, wherein said feed point (19) is provided on a first side of the substrate (11;61) and said feeding means (2) is coupled to said feed point (19) from a second side of said substrate (11;6l) via a conductive path (25) through the substrate (11;61).

5. The antenna device according to claim 4, wherein said conductive path (25) is a via hole.

6. The antenna device according to claim 4, wherein said feeding means (2) is connected to said conductive path (25) via a waveguide (24).

7. The antenna device according to claim 4, wherein said substrate (11;61)) is provided with an integrated circuit and/or lumped components (53) on the second side of said substrate (11;61).

8. The antenna device according to claim 7, wherein said integrated circuit and/or lumped components (53) comprises an amplifier, preferably a low-noise amplifier.

9. The antenna device according to claim 1, wherein said dielectric substrate (11) is a PCB.

10. The antenna device according to claim 1, wherein said antenna device is adapted for reception of GPS-signals.

11. The antenna device according to claim 1, wherein said closed slot (71) is provided with at least a portion having a meandering path.

12. The antenna device according to claim 1, wherein said antenna device is further provided with a reflector (21;31;62) made out of a conductive material arranged so as to create a space (22;34;64) between said substrate (11;61) and said reflector (21;31;62).

13. The antenna means according to claim 12, wherein said space (22) is filled with a dielectric material.

14. The antenna device according to claim 12, wherein said reflector (21;31;62) is provided essentially parallel to said substrate (11;61).

15. The antenna device according to claim 12, wherein said reflector (31;62) is provided with at least two side walls (33;63), said side walls being essentially perpendicularly arranged relative to said reflector (31;62) and defining a distance (h) between said substrate (11;61) and said reflector (31;62).

16. The antenna device according to claim 15, wherein said side walls (33;63) are electrically connected to said reflector (31;62).

17. The antenna device according to claim 16, wherein said outer conductive region (12) is electrically connected to at least one of said side walls (33).

18. The antenna device according to claim 17, wherein said outer conductive region (12) is electrically connected to said at least one side walls (33) by soldering.

19. The antenna device according to claim 14, wherein said reflector (31;63) and side walls (33;63) are made from the same piece of material.

20. The antenna device according to claim 12, wherein said reflector (21;31;62) is a metal sheet.

21. The antenna device according to claim 1, wherein said closed slot (14;71;81;91) has an essentially rectangular path.

22. The antenna device according to claim 1, wherein said outer region (12) has a feeding portion connectable to a second feed means for operation as a radiating element operating in at least one further frequency band.

23. An antenna assembly comprising a first antenna device (111;121;131) having a conductive layer (113;123), characterised in that said first antenna device is provided with a second antenna device (112;122;132) claim 1, arranged in said conductive layer (113;123).

* * * * *